US007073450B2

(12) United States Patent
Tsai

(10) Patent No.: US 7,073,450 B2
(45) **Date of Patent: *Jul. 11, 2006**

(54) STACKABLE TABLETOP FOR FORDABLE TABLE

(75) Inventor: Frank Tsai, Taipei (TW)

(73) Assignee: Wok & Pan Ind., Inc., Guang Dong (CN)

( * ) Notice: Subject to any disclaimer, the term of this patent is extended or adjusted under 35 U.S.C. 154(b) by 48 days.

This patent is subject to a terminal disclaimer.

(21) Appl. No.: 10/704,312

(22) Filed: Nov. 10, 2003

(65) Prior Publication Data

US 2005/0098068 A1 May 12, 2005

(51) Int. Cl.
*A47B 9/00* (2006.01)

(52) U.S. Cl. ..... 108/132; 108/91

(58) Field of Classification Search ..... 108/91, 108/132, 131, 130, 53.1, 53.3, 53.8, 92
See application file for complete search history.

(56) References Cited

U.S. PATENT DOCUMENTS 1,593,975 A * 7/1926 Karstens ..... 108/91
2,889,185 A * 6/1959 Heisler ..... 108/91
3,747,539 A * 7/1973 Calzaretto ..... 108/91
4,879,774 A * 11/1989 Sanders ..... 108/91
5,505,142 A * 4/1996 Fink ..... 108/91
6,234,088 B1 * 5/2001 Bredal et al. ..... 108/91
6,394,004 B1 * 5/2002 Lynn ..... 108/91
6,675,724 B1 * 1/2004 Bruschi et al. ..... 108/91
6,732,663 B1 * 5/2004 Tsai ..... 108/132
6,823,806 B1 * 11/2004 Buono ..... 108/132
6,877,441 B1 * 4/2005 Zheng ..... 108/130

* cited by examiner

*Primary Examiner*—José V. Chen
(74) *Attorney, Agent, or Firm*—Raymond Y Chan; David and Raymond Patent Group

(57) ABSTRACT

A stackable tabletop includes a tabletop member having a top surface defining a peripheral edge portion and a first contour formed therealong and a bottom surface adapted for pivotally connecting two leg assemblies thereon, and an engaging rim, which is provided along a peripheral edge portion of the bottom surface of the tabletop member, defining a second contour formed therealong, wherein the second contour of the engaging rim has a size and shape geometrically matching with the first contour of the top surface. Therefore, the stackable tabletop is adapted to overlappedly stack on another stackable tabletop by engaging the second contour of the engaging rim of the stackable tabletop with the first contour of the top surface of the another stackable tabletop so as to substantially retain the two stackable tabletops in position and avoid a lateral relative movement between the stackable tabletop and the another stackable tabletop.

12 Claims, 5 Drawing Sheets

STACKABLE TABLETOP FOR FORDABLE TABLE

BACKGROUND OF THE PRESENT INVENTION

1. Field of Invention

The present invention relates to a tabletop for foldable tables, and more particularly to a stackable tabletop having geometrically conditioned contours that enable the tabletop to stack on another of the same kind with substantial retaining force therebetween.

2. Description of Related Arts

The transportable utility renders the fordable tables being useful for various kinds of activities, such as annual meetings in school's hall, church gathering, beverage reception in a particular university's podium, exhibitions, and the likes. Very often, these participant-intensive activities take place in multi-function rooms or designated areas in which the related furniture and equipments are temporary set up. After the functions, all the furniture and equipment will be cleared from the multi-function rooms or the designated areas and neatly stored to, say, other storage room for further uses, and the multi-function rooms or the designated areas will be made over for other purposes.

Fordable tables are usually utilized by function's host to support or retain the necessary equipment in that they are foldable and portable so that they can be easily set up when necessary, and removed after the functions ended. A conventional foldable table usually comprises a tabletop having a utilizing portion on top of which beverage, food, documents and other miscellaneous items may be placed, to whose bottom surface at least a pair of leg frames pivotally attached to provide structural support in a foldable manner.

Regarding to such conventional foldable table, some deep-seated drawbacks can be found. First, foldable tables are hard to stack up. Foldable tables are prevalent because of their flexibility. When needed, they can be unfolded for retaining and supporting a variety of objects. When they are not needed, they can be folded up into a relatively compact size for storage. Of course, most of the conventional foldable tables allow users to fold up their legs in order to make them more compact. There is nothing wrong with each individual foldable table. However, many organizations need lots of foldable tables for large-scale functions, storing a large number of them in another story. Typically, one may erect the folded foldable tables one by one and overlappedly lay them in order. One potential problem of this practice is that the foldable tables easily collapse. In order to prevent them from collapsing, some sort of strings or ropes may have to be used to tighten them. In other cases, one may wish to stack up all the foldable tables. However, the user may not be able to do so simply because the upper one may not be able to securely stack on the lower one.

Second, the foldable table may not be secure enough. In order that the foldable table to be portable, the material used for manufacturing the tabletop should be light in weigh, such as plastic. This can be easily justified by the fact that most of the conventional foldable tables have their tabletops made by come sort of plastic. However, light material probably suffers from inadequate strength, making the foldable table not secure enough, especially when it is loaded with fairly heavy objects. Though some manufacturers employ light but strong material, such as fiber reinforced composites, the foldable table made by this kind of material is unavoidably expensive which decreases the willingness of consumers to buy this product. One may choose to sacrifice the portability of the foldable table by making the tabletop with heavier and more rigid material. Nonetheless, portability and rigidity are mutually contending.

Besides, almost all conventional foldable tables have their respective tabletop supported at four corner portions, or at least separate supporting points along the edge portion of the tabletop. However, very often, an object will be placed at the middle portion of the tabletop. This creates a large bending moment to the tabletop and, if the tabletop was not strong enough, it would be broken or deflected after being used for a period of time. Also, with such kinds of mechanical designs, any loading loaded on the tabletop will not be evenly shared among the foldable table frame.

SUMMARY OF THE PRESENT INVENTION

An objective of the present invention is to provide a stackable tabletop that can be easily and securely stacked on top of another, so as to enhance the stabilization of the tabletops during transportation and storage.

Another objective of the present invention is to provide a stackable tabletop that has geometrically conditioned contours between the contact surfaces between two piled-up stackable tabletops so as to substantially avoid lateral movement therebetween. In other words, no fastening device, such as string, is required to tight up the tabletops together to retain the tabletops in position.

Another object of the present invention is to provide a stackable tabletop, wherein the tabletops are physically engaged with each other in a stackable manner to stably retain the tabletops in position so as to minimize the manufacturing cost of each of the tabletops by simplifying the structure thereof.

Another object of the present invention is to provide a stackable tabletop, wherein the operation is quick and easy that by simply stacking up one tabletop on top of another tabletop.

Another objective of the present invention is to provide a stackable tabletop that is capable of receiving its folded leg frames without exposing from the predetermined depth of the tabletop.

Another objective of the present invention is to provide a stackable tabletop with side-runners to structurally enhance the stackable tabletop.

Another objective of the present invention is to provide a variety ways to form the geometrically conditioned contours capable of substantially avoiding lateral movement between two piled-up stackable tabletops.

Accordingly, in order to accomplish the above objects, the present invention provides a stackable tabletop for a foldable table having two leg assemblies, wherein the tabletop comprises:

a tabletop member having a top surface defining a peripheral edge portion and a first contour formed therealong, and a bottom surface adapted for pivotally and spacedly connecting the two leg assemblies thereon, and an engaging rim, which is provided along a peripheral edge portion of the bottom surface of the tabletop member, defining a second contour formed therealong, wherein the second contour of the engaging rim has a size and shape geometrically matching with the first contour of the top surface, whereby the stackable tabletop is adapted to overlappedly stack on another stackable tabletop by engaging the second contour of the engaging rim of the stackable tabletop with the first contour of the top surface of the another stackable tabletop so as to substantially retain the two stackable tabletops in position and avoid a lateral relative movement between the stackable tabletop and the another stackable tabletop.

These and other objectives, features, and advantages of the present invention will become apparent from the following detailed description, the accompanying drawings, and the appended claims.

DETAILED DESCRIPTION OF THE PREFERRED EMBODIMENT

Figure 1:
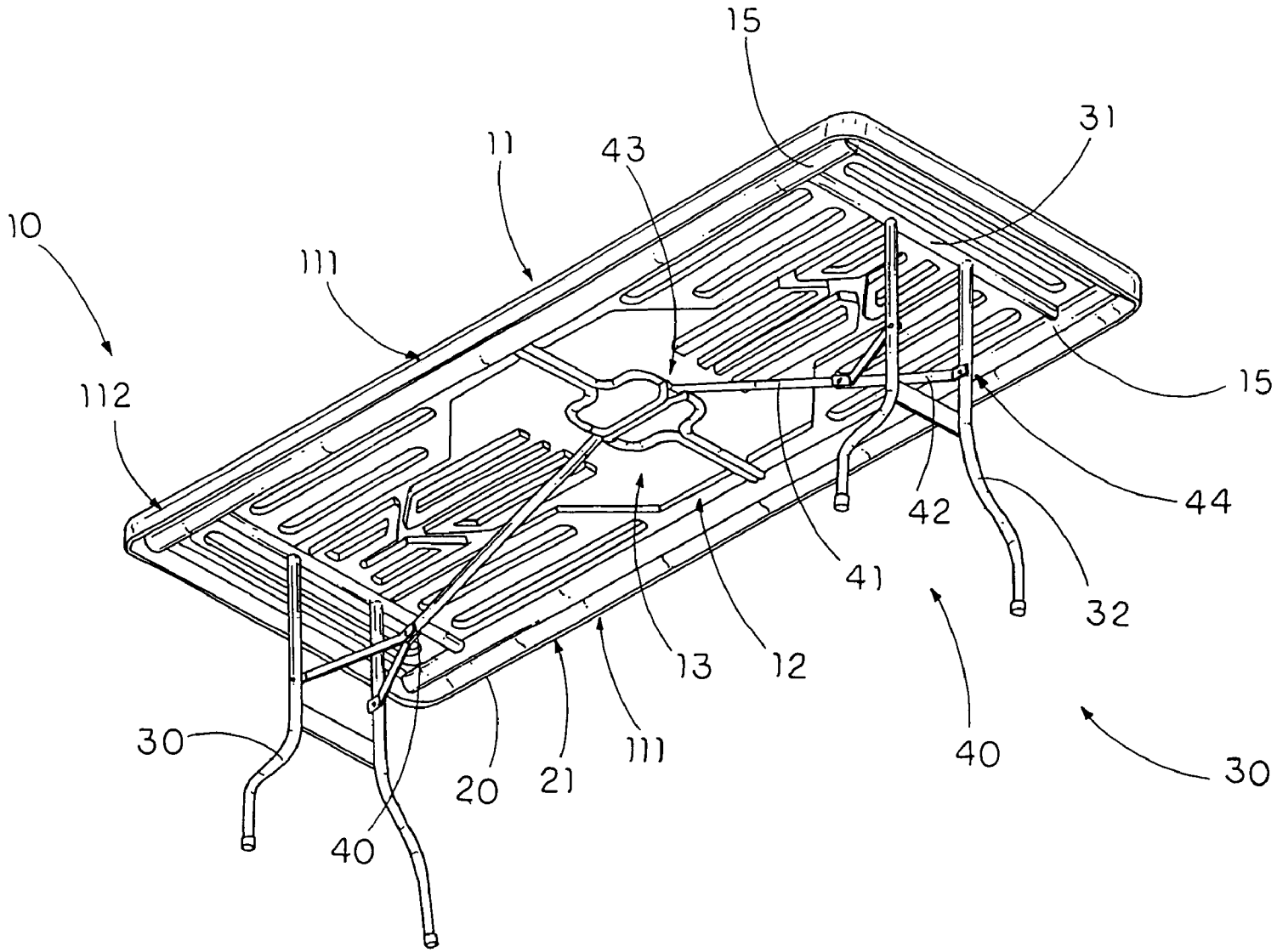
FIG. 1 is a perspective view of a tabletop with folded leg frames attached thereunder according to a preferred embodiment of the invention.

Referring to FIG. 1, a stackable tabletop generally designated as according to a preferred embodiment of the present invention is illustrated, wherein the stackable tabletop adapted for incorporating with a foldable table comprising two legs assemblies.

The stackable tabletop comprises a tabletop member 10 having a top surface 11 defining a peripheral edge portion 111 and a first contour 112 formed therealong, and a bottom surface 12 adapted for pivotally and spacedly connecting the two leg assemblies thereon. It is noted that the stackable tabletop can actually stand alone and accommodate different types of leg assemblies other than the ones shown in this figure.

The stackable tabletop further comprises an engaging rim 20, which is provided along a peripheral edge portion of the bottom surface 12 of the tabletop member 10, defining a second contour 21 formed therealong, wherein the second contour 21 of the engaging rim 20 has a size and shape geometrically matching with the first contour 112 of the top surface 11 of the tabletop member 10.

Therefore, the stackable tabletop is adapted to overlappedly stack on another stackable tabletop by engaging the second contour 21 of the engaging rim 20 of the stackable tabletop with the first contour 112 of the top surface 11 of the another stackable tabletop so as to substantially retain the two stackable tabletops in position and avoid a lateral relative movement between the stackable tabletop and the another stackable tabletop.

According to the preferred embodiment, the tabletop member 10, which is a single layer plastic tabletop, is made of light weight but rigid material such as plastic by plastic 'air blow' extrusion molding or Fiber Reinforced Polymer (FRP) composites such that the top surface 11 is integrally formed with the bottom surface 12. It is preferable that the process of manufacturing the tabletop member 10 is simplified through the plastic 'air blow' extrusion molding technique so as to minimize the manufacturing cost of the stackable tabletop of the present invention. It is noted that the stackable tabletop can also be made of other materials, like metal and wood according to various considerations.

In the preferred embodiment, the tabletop member 10 has two longitudinal sides and two transverse sides such that defining a rectangular shape, which is particularly suitable for purposes like preparation of meetings, hosting reception banquets and exhibition of items. It is noted that, the present invention is not limited to rectangular shaped tabletops. Other shapes, like round and triangular, can be adopted in difference circumstances without departing the spirit of the present invention.

Figure 2:
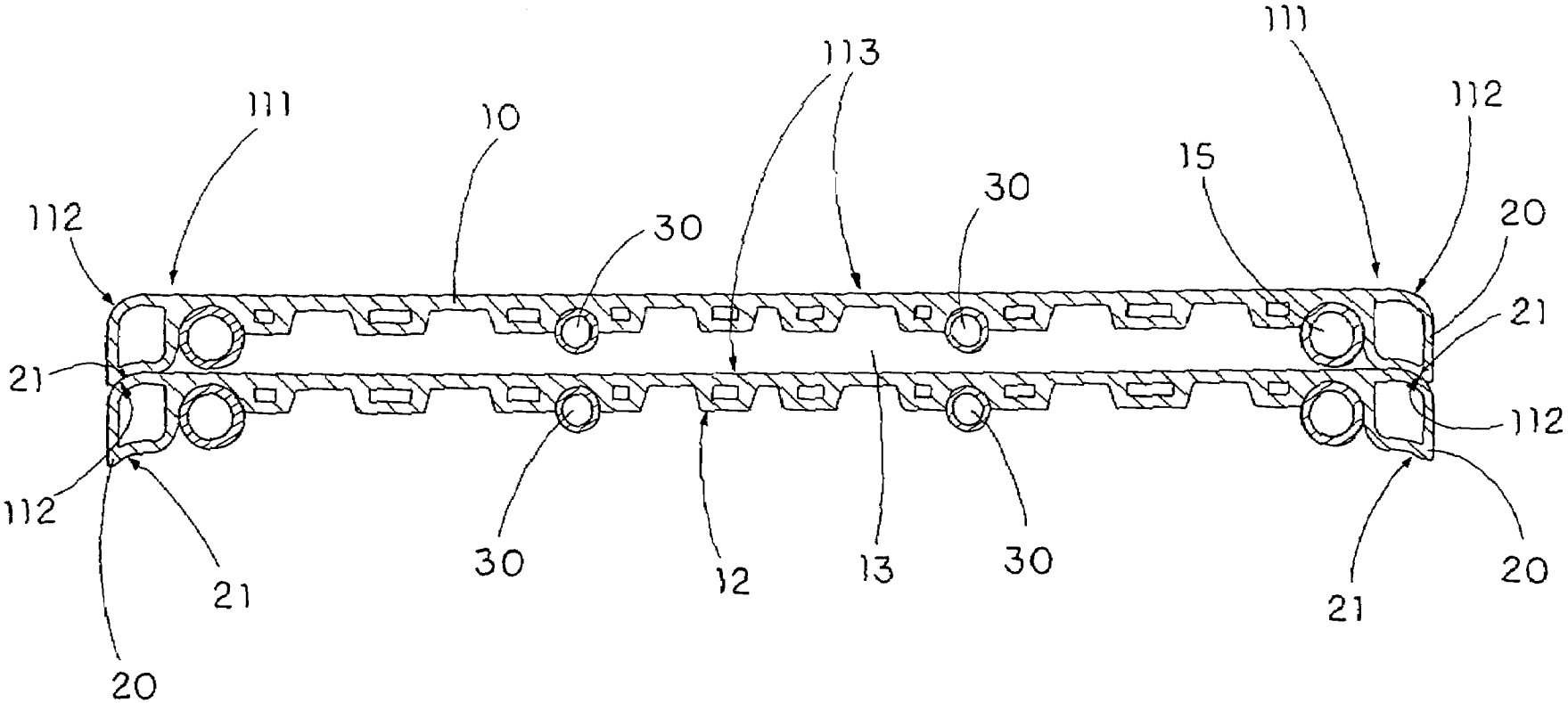
FIG. 2 is a cross-sectional view of two stacked tabletops according to the preferred embodiment of the invention.

Referring to FIG. 2, a cross-sectional view illustrates a stackable tabletop is stacked on top of another. The tabletop member 10 has a curved top resting edge as the first contour 112 formed along the peripheral edge portion 111 of the top surface 11, wherein the tabletop member 10 further has an upper utilizing portion 113 defining within the peripheral edge portion 111.

The engaging rim 20 is downwardly extended from the peripheral edge portion of the bottom surface 12 of the tabletop member 10 to define a receiving cavity 13 within the engaging rim 20 and the bottom surface 12 of the tabletop member 10 for receiving the utilizing portion 113 of the top surface 11 of the another stackable tabletop when the stackable tabletop is piled up of the another stackable tabletop. As shown in FIG. 2, the engaging rim 20 is integrally extended from the tabletop member 10 to align with the first contour 112 of the another stackable tabletop when the stackable tabletop is piled up of the another stackable tabletop. In other words, the engaging rim 20 is integrally extended from the tabletop member 10 to form a one piece integral stackable tabletop so as to minimize the manufacturing cost of the tabletop member 10 incorporating with the engaging rim 20.

In the preferred embodiment, the second contour 21 is an engaging edge groove indently and peripherally extended along an inner surface of the engaging rim 20, wherein the engaging edge groove of the second contour 21 is shaped and sized corresponding to a shape and size of the top resting edge of the first contour 112 of the tabletop member 10. Therefore, when the two stackable tabletops are piled up with each other, the top resting edge of the another stackable tabletop is engaged with the engaging edge groove and surrounded by the engaging rim of the stackable tabletop so as to substantially retain the two stackable tabletop and avoid the lateral relative movement between the stackable tabletop and the another stackable tabletop.

When a stackable tabletop is stacked on top of another, the weight of the upper stackable tabletop would distribute among the contact surfaces between the resting edge of the first contour 112 along the peripheral edge portion 111 and the second contour 21 of the engaging rim 20 so as to generate a substantial retaining force to hold the pile of stackable tabletops in a stable manner. As result, a good number of stackable tabletops can be piled up and the risk of their collapse is reduced.

It is noted that while in the preferred embodiment the geometrically conditioned first and second contours 112 and 21 are continuously extended along the peripheral edge portion 111 and the engaging rim 20 respectively, they can be made in a discontinuous fashion. For example, the corresponding first and second contours 112 and 21 can be made only to several corresponding sections of the peripheral edge portion 111 and the engaging rim 20 respectively without continuously extending around the whole boundaries of the stackable tabletop.

The stackable tabletop further comprises two side-runners 15 longitudinally disposed along two longitudinal side portions of the bottom surface 12 of the tabletop member 10 to structurally strengthen the tabletop member 10. Because the side-runners 15 are made of rigid material that has an elastic coefficient much smaller that that of the rest of the stackable tabletop, the bending moment applied to the top surface 11 of the tabletop member 10 is predominantly absorbed by the side-runners 15 with little deflection. It is noted that the side-runners 15 are received within the receiving cavity 13 of the tabletop member 10 wherein the height of each of the side-runners 15 must be smaller than the height of the engaging rim 20, while the shapes and structures of the side-runners 15 can be adopted without departing the spirit of the invention. It is further noted that the side-runners 15 may be diagonally disposed on the bottom surface 12, or in arrangements other than longitudinal disposition, as long as such arrangement enhances the structural strength of the stackable tabletop.

As shown in FIG. 1, the two leg assemblies are pivotally mounted on the bottom surface 12 of the tabletop member 10 in a foldably movable manner wherein each of the leg assemblies comprises leg frames 30 and a retaining frame 40.

Each of the leg frames 30 has an upper portion pivotally connected to the bottom surface 12 of the tabletop member 10. Accordingly, each of the leg frames 30 comprises a transverse member 31 rotatably connected between the two side-runners 15 and a standing leg 32 downwardly extended from the transverse member 31 in such a manner that each of the leg frames 30 is adapted to fold between a folded position and an unfolded position. At the folded position, each of the leg frames 30 is pivotally and inwardly folded within the receiving cavity 13 to rest on the bottom surface 12 of the tabletop member 10. At the unfolded position, each of the leg frames 30 is pivotally and outwardly folded to perpendicularly extend from the tabletop member 10.

Each retaining frame 40 comprises a retaining brace 41 and a retaining arm 42 pivotally connected thereto. The retaining frame 40 has a fixed end 43 and free end 44, wherein the fixed end 43 is pivotally attached to the bottom surface 12 of tabletop member 10, and the free end 44 is distant away from the standing leg 32. Thus, when the leg frames 30 are in a folded position, the retaining braces 41 and retaining arms 42 are laid flat on the bottom surface 12 of the stackable tabletop. When the leg frames 30 are in an unfolded position, the retaining brace 41 and retaining arm 42 are pivotally unfolded for prohibiting a further unfolding pivotal movement of the leg frame 30 and therefore to retain the leg frame 30 in an unfolded position.

In order to enable the stacking mechanism as described in the foregoing paragraphs, the side-runners 15 and the leg assemblies (the leg frames 30 and the retaining frames 40) should be completely received within the receiving cavity 13 under the bottom surface 12 of the tabletop member 10 when the leg frames 30 are in a folded position, so that the peripheral edge portion 111 of one stackable tabletop is capable of engaging with the engaging rim 20 of another stackable tabletop. In other words, the height of engaging rim 20 should be greater than the thickness of the side-runners 15 and leg frames 30 as they are in a folded position.

When a foldable table that adopts the present stackable tabletop is needed, one can simply take it away from storage, and unfold the leg frames 30 to their unfolded position. When the leg frames 30 are totally unfolded, i.e. in the unfolded position, the foldable table should be erected on the ground and ready for use. When the foldable table is not in use, one can just simply fold up the leg frames 30 and lay them flat on the bottom surface 12. If more than one foldable table are needed, the user can pile up all the foldable tables by engaging the peripheral edge potion 111 of one with the engaging rim 20 of another.

Besides the stackable feature, the stackable tabletop has an advantage of ease of manufacturing. Accordingly, the tabletop member 10 can be simply made by any plastic molding technique to form the integral engaging rim 20 on the bottom surface 12 of the tabletop member 10. Then, by affixing the two side-runners 15 on the bottom surface 12 of the tabletop member 10 within the receiving cavity 13, the stackable tabletop of the present invention is formed.

Figure 3:
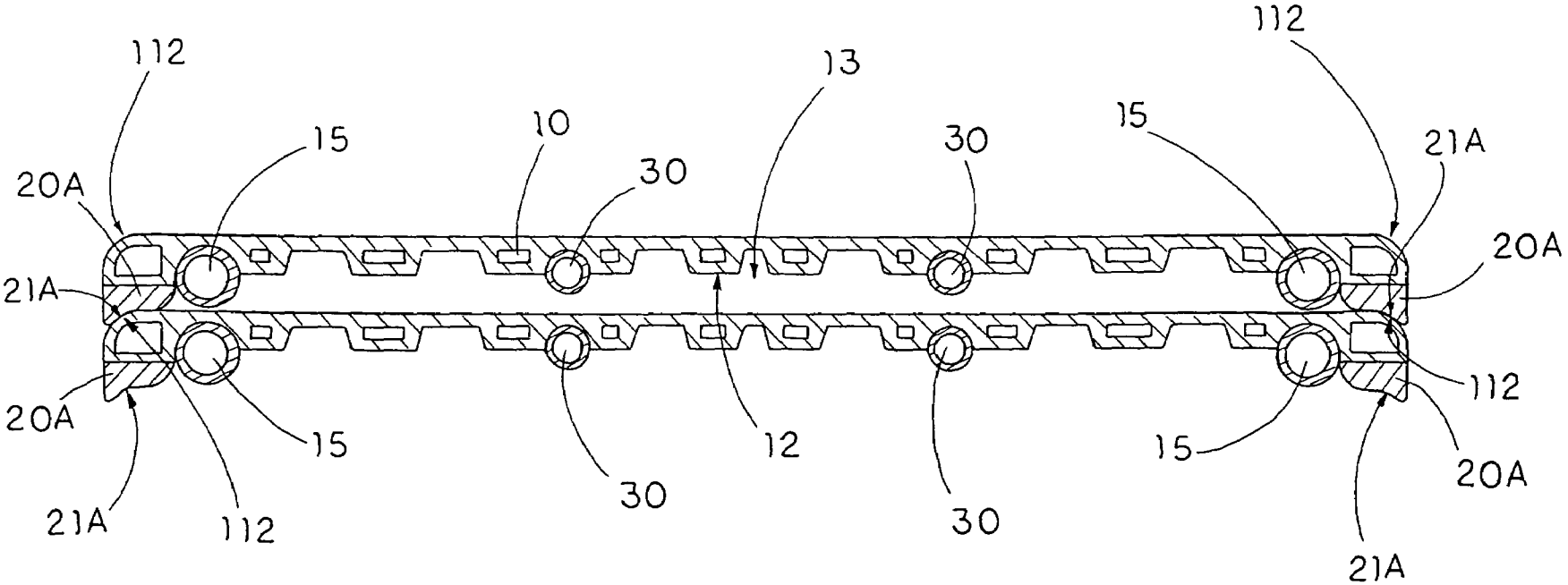
FIG. 3 is a cross-sectional view of two stacked tabletops according to an alternative of the preferred embodiment of the invention.

Referring to FIG. 3, an alternative mode of the engaging rim is shown, wherein the engaging rim 20A is attached to the peripheral edge portion of the bottom surface 12 of the tabletop member 10 to define the receiving cavity 13. As shown in FIG. 3, the second contour 21A is an engaging edge groove indently and peripherally extended along an inner surface of the engaging rim 20A, wherein the engaging edge groove of the second contour 21A is shaped and sized corresponding to a shape and size of the top resting edge of the first contour 112 of the tabletop member 10. Therefore, the stackable tabletop can be stacked on top of one another with a substantially retaining force generated between the peripheral edge portion 112 and the engaging rim 20A to hold the pile of stackable tabletops in a stable manner.

It is worth to mention that the side-runners 15 and the leg frames 30 should be completely received in the receiving cavity 13 under the bottom surface 12 when the leg frames 30 are in a folded position, so that the peripheral edge portion 111 of one stackable tabletop is capable of engaging with the engaging rim 20A of another stackable tabletop without substantial interference from the leg frames 30 and the side-runners 15.

Accordingly, the engaging rim 20A can be incorporated with any conventional tabletop by affixing the engaging rim 20A to the peripheral edge portion of the bottom surface 12 of the tabletop member 10 to form the stackable tabletop of the present invention such that the stackable tabletops are adapted to pile up with each other in a stabilized manner.

Figure 4:
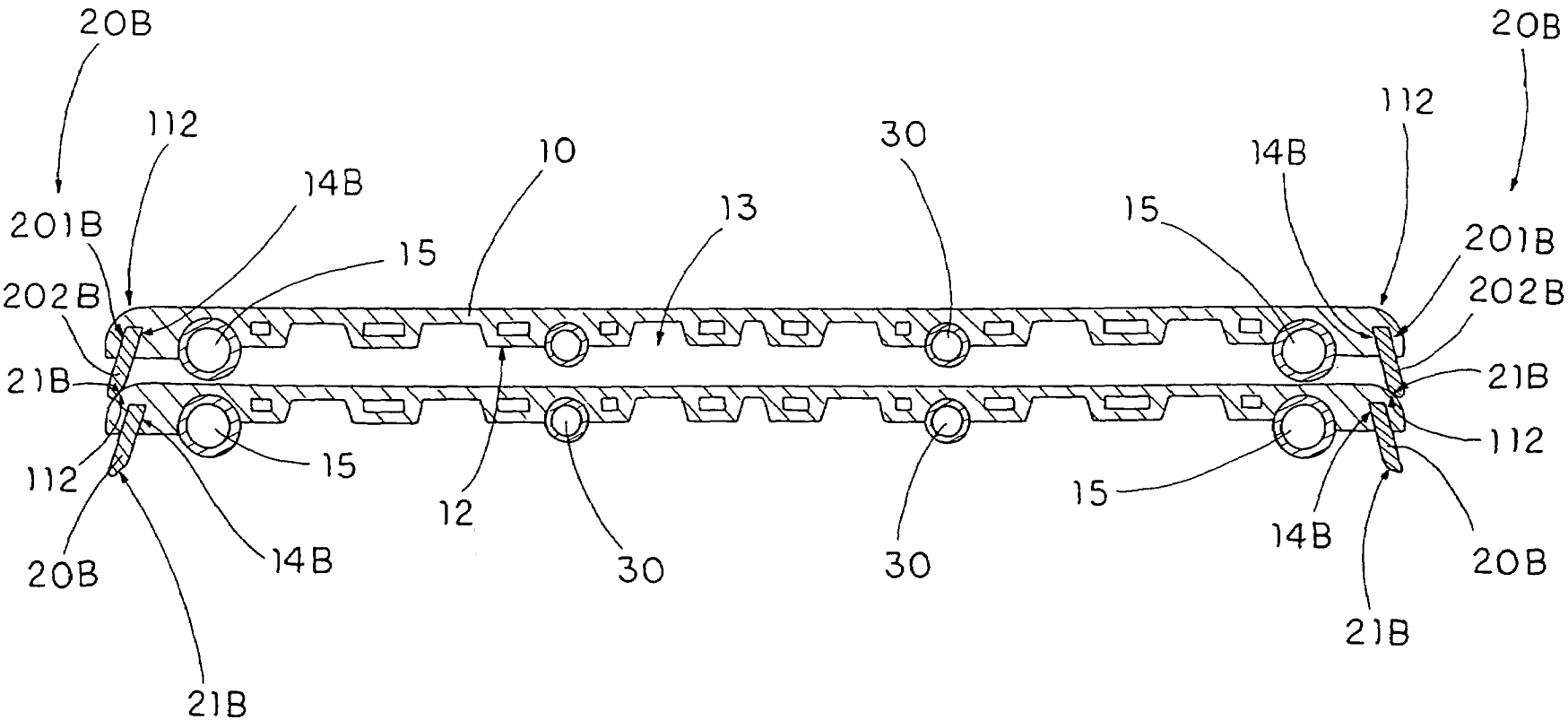
FIG. 4 is a cross-sectional view of two stacked tabletops according to another alternative of the preferred embodiment of the invention.

FIG. 4 illustrates another alternative mode of the stackable tabletop, wherein the tabletop member 10 has similar configuration as the stackable tabletop as shown in FIG. 2. As shown in FIG. 4, the tabletop member 10 further has a holding groove 14B indently formed along the peripheral edge portion of the bottom surface 12. The engaging rim 20B has an upper attaching portion 201B securely received along the holding groove 14B and a lower engaging portion 202B downwardly extended from the bottom surface 12 of the tabletop member 10 to define the receiving cavity 13, wherein the engaging edge groove of the second contour 21B is formed on an inner side of the engaging portion 202B of the engaging rim 20B for fittingly engaging with the top resting edge of the first contour 112 of the another stackable tabletop.

Preferably, the engaging portion 202B of the engaging rim 20B is outwardly and inclinedly extended from the peripheral edge portion of the bottom surface 12 of the tabletop member 10, so as to enhance the stabilization of the stackable tabletops when two stackable tabletops are overlappedly piled up with each other.

Figure 5:
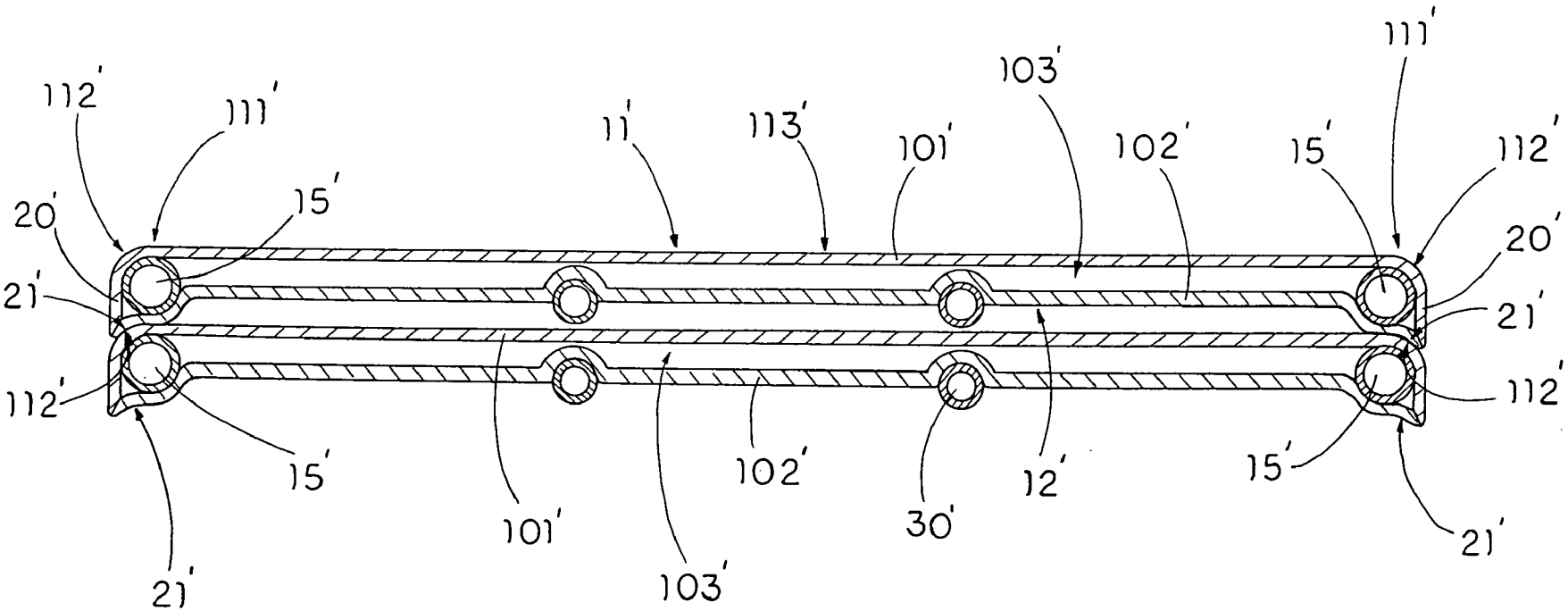
FIG. 5 is a cross-sectional view of two stacked tabletops according to yet another alternative of the preferred embodiment of the invention.

Referring to FIG. 5, a cross-sectional view of another alternative of preferred embodiment is illustrated. The tabletop member 10', which is a double-layer plastic tabletop, comprises a plastic top layer 101' defining the top surface 11' thereon and a plastic bottom layer 102' which defines the bottom surface 12' thereon and is overlappedly connected to the top layer 101' in an edge to edge manner to form an air chamber 103' between the top and bottom layers 101', 102'.

As shown in FIG. 5, the tabletop member 10' has a curved top resting edge as the first contour 112' formed along the peripheral edge portion 111' of the top surface 11' of the top layer 101', wherein the tabletop member 10' further has an upper utilizing portion 113' within the peripheral edge portion 111'.

The engaging rim 20' is downwardly and integrally extended from the peripheral edge portion of the bottom surface 12' of the bottom layer 102' of the tabletop member 10' to define a receiving cavity 13' within the engaging rim 20' and the bottom surface 12' of the tabletop member 10' for receiving the utilizing portion 113' of the top surface 11' of the another stackable tabletop when the stackable tabletop is piled up of the another stackable tabletop.

The second contour 21' is an engaging edge groove indently and peripherally extended along an inner surface of the engaging rim 20', wherein the engaging edge groove of the second contour 21' is shaped and sized corresponding to a shape and size of the top resting edge of the first contour 112' of the tabletop member 10'.

Accordingly, the two side-runners 15' are received in the air chamber 103' between the top and bottom layers 101', 102' to longitudinally extended along two longitudinal side portions of the tabletop member 10'.

According to the abovementioned embodiments and alternatives, the present invention provides, but not limited to, the following advantages. First, the stackable tabletop can be easily and stably stacked on top of another with reduced risk of collapse. Second, the balance of cost, weight and structure strength can be achieved by varying the implement of the structure enhancing member and the grooves on the bottom surface of the tabletop. Finally, a variety ways to manufacture the tabletop are provided for more selections.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A stackable tabletop for a foldable table having two leg assemblies, wherein said tabletop comprises:

a tabletop member having a top surface defining a peripheral edge portion and a first contour formed therealong, and a bottom surface adapted for pivotally and spacedly connecting said two leg assemblies thereon, and an engaging rim, which is provided along a peripheral edge portion of said bottom surface of said tabletop member, defining a second contour formed therealong, wherein said second contour of said engaging rim has a size and shape geometrically matching with said first contour of said top surface, wherein said tabletop member further has an upper utilizing portion defining within said peripheral edge portion, wherein said engaging rim is downwardly extended from said peripheral edge portion of said bottom surface of said tabletop member to define a receiving cavity within said engaging rim and said bottom surface of said tabletop member for receiving said leg assemblies and for receiving said utilizing portion of said top surface of said another stackable tabletop when said stackable tabletop is piled up of said another stackable tabletop, wherein said tabletop member further has a holding groove indently formed along said peripheral edge portion of said bottom surface, wherein said engaging rim has an upper attaching portion securely received along said holding groove and a lower engaging portion downwardly extended from said bottom surface of said tabletop member, wherein said second contour is formed on an inner side of said engaging portion of said engaging rim for fittingly engaging with said first contour of said another stackable tabletop, whereby said stackable tabletop is adapted to overlappedly stack on another stackable tabletop by engaging said second contour of said engaging rim of said stackable tabletop with said first contour of said top surface of said another stackable tabletop so as to substantially retain said two stackable tabletops in position and avoid a lateral relative movement between said stackable tabletop and said another stackable tabletop.

2. A stackable tabletop for a foldable table having two leg assemblies, wherein said tabletop comprises:

a tabletop member having a top surface defining a peripheral edge portion and a first contour formed therealong, and a bottom surface adapted for pivotally and spacedly connecting said two leg assemblies thereon, and an engaging rim, which is provided along a peripheral edge portion of said bottom surface of said tabletop member, defining a second contour formed therealong, wherein said second contour of said engaging rim has a size and shape geometrically matching with said first contour of said top surface, wherein said tabletop member further has an upper utilizing portion defining within said peripheral edge portion, wherein said engaging rim is downwardly extended from said peripheral edge portion of said bottom surface of said tabletop member to define a receiving cavity within said engaging rim and said bottom surface of said tabletop member for receiving said leg assemblies and for receiving said utilizing portion of said top surface of said another stackable tabletop when said stackable tabletop is piled up of said another stackable tabletop, wherein said tabletop member has a top resting edge as said first contour formed along said peripheral edge portion of said top surface, wherein said second contour is an engaging edge groove indently and peripherally extended along an inner surface of said engaging rim, wherein said engaging edge groove of said second contour is shaped and sized corresponding to a shape and size of said top resting edge of said first contour of said tabletop member, wherein said tabletop member further has a holding groove indently formed along said peripheral edge portion of said bottom surface, wherein said engaging rim has an upper attaching portion securely received along said holding groove and a lower engaging portion downwardly extended from said bottom surface of said tabletop member, wherein said second contour is formed on an inner side of said engaging portion of said engaging rim for fittingly engaging with said first contour of said another stackable tabletop, whereby said stackable tabletop is adapted to overlappedly stack on another stackable tabletop by engaging said second contour of said engaging rim of said stackable tabletop with said first contour of said top surface of said another stackable tabletop so as to substantially retain said two stackable tabletops in position and avoid a lateral relative movement between said stackable tabletop and said another stackable tabletop, whereby, when said two stackable tabletops are piled up with each other, said top resting edge of said another stackable tabletop is engaged with said engaging edge groove and surrounded by said engaging rim of said stackable tabletop so as to substantially retain said two stackable tabletop and avoid said lateral relative movement between said stackable tabletop and said another stackable tabletop.

3. The stackable tabletop, as recited in claim 2, wherein said tabletop member is a single layer plastic tabletop defining said top surface and said bottom surface.

4. The stackable tabletop, as recited in claim 3, further comprising two side-runners supported within said receiving cavity to longitudinally extend two longitudinal side edge portions of said tabletop member respectively.

5. The stackable tabletop, as recited in claim 2, wherein said tabletop member, which is a double-layer plastic tabletop, comprises a plastic top layer defining said top surface thereon and a plastic bottom layer which defines said bottom surface thereon and is overlappedly connected to said top layer in an edge to edge manner to form an air chamber between said top and bottom layers.

6. The stackable tabletop, as recited in claim 5, further comprising two side-runners supported within said air chamber to longitudinally extend two longitudinal side edge portions of said tabletop member respectively.

7. A stackable tabletop for a foldable table having two leg assemblies, wherein said tabletop comprises:

a tabletop member having a top surface defining a peripheral edge portion and a first contour formed therealong, and a bottom surface adapted for pivotally and spacedly connecting said two leg assemblies thereon, an engaging rim, which is provided along a peripheral edge portion of said bottom surface of said tabletop member, defining a second contour formed therealong, wherein said second contour of said engaging rim has a size and shape geometrically matching with said first contour of said top surface, and two side-runners, wherein said tabletop member has a top resting edge as said first contour formed along said peripheral edge portion of said top surface, wherein said second contour is an engaging edge groove indently and peripherally extended along an inner surface of said engaging rim, wherein said engaging edge groove of said second contour is shaped and sized corresponding to a shape and size of said top resting edge of said first contour of said tabletop member, wherein said tabletop member further has an upper utilizing portion defining within said peripheral edge portion, wherein said engaging rim is downwardly extended from said peripheral edge portion of said bottom surface of said tabletop member to define a receiving cavity within said engaging rim and said bottom surface of said tabletop member for receiving said leg assemblies and for receiving said utilizing portion of said top surface of said another stackable tabletop when said stackable tabletop is piled up of said another stackable tabletop, wherein said engaging rim is downwardly and integrally extended from said peripheral edge portion of said bottom surface of said tabletop member, wherein said tabletop member is a single layer plastic tabletop defining said top surface and said bottom surface, wherein two side-runners are supported within said receiving cavity to longitudinally extend two longitudinal side edge portions of said tabletop member respectively, whereby said stackable tabletop is adapted to overlappedly stack on another stackable tabletop by engaging said second contour of said engaging rim of said stackable tabletop with said first contour of said top surface of said another stackable tabletop so as to substantially retain said two stackable tabletops in position and avoid a lateral relative movement between said stackable tabletop and said another stackable tabletop, whereby, when said two stackable tabletops are piled up with each other, said top resting edge of said another stackable tabletop is engaged with said engaging edge groove and surrounded by said engaging rim of said stackable tabletop so as to substantially retain said two stackable tabletop and avoid said lateral relative movement between said stackable tabletop and said another stackable tabletop.

8. A stackable tabletop for a foldable table having two leg assemblies, wherein said tabletop comprises:

a tabletop member having a top surface defining a peripheral edge portion and a first contour formed therealong, and a bottom surface adapted for pivotally and spacedly connecting said two leg assemblies thereon, an engaging rim, which is provided along a peripheral edge portion of said bottom surface of said tabletop member, defining a second contour formed therealong, wherein said second contour of said engaging rim has a size and shape geometrically matching with said first contour of said top surface, and two side-runners, wherein said tabletop member has a top resting edge as said first contour formed along said peripheral edge portion of said top surface, wherein said second contour is an engaging edge groove indently and peripherally extended along an inner surface of said engaging rim, wherein said engaging edge groove of said second contour is shaped and sized corresponding to a shape and size of said top resting edge of said first contour of said tabletop member, wherein said tabletop member further has an upper utilizing portion defining within said peripheral edge portion, wherein said engaging rim is downwardly extended from said peripheral edge portion of said bottom surface of said tabletop member to define a receiving cavity within said engaging rim and said bottom surface of said tabletop member for receiving said leg assemblies and for receiving said utilizing portion of said top surface of said another stackable tabletop when said stackable tabletop is piled up of said another stackable tabletop, wherein said engaging rim is affixed to said peripheral edge portion of said bottom surface of said tabletop member, wherein said tabletop member is a single layer plastic tabletop defining said top surface and said bottom surface, wherein two side-runners are supported within said receiving cavity to longitudinally extend two longitudinal side edge portions of said tabletop member respectively, whereby said stackable tabletop is adapted to overlappedly stack on another stackable tabletop by engaging said second contour of said engaging rim of said stackable tabletop with said first contour of said top surface of said another stackable tabletop so as to substantially retain said two stackable tabletops in position and avoid a lateral relative movement between said stackable tabletop and said another stackable tabletop, whereby, when said two stackable tabletops are piled up with each other, said top resting edge of said another stackable tabletop is engaged with said engaging edge groove and surrounded by said engaging rim of said stackable tabletop so as to substantially retain said two stackable tabletop and avoid said lateral relative movement between said stackable tabletop and said another stackable tabletop.

9. A stackable tabletop for a foldable table having two leg assemblies, wherein said tabletop comprises:

a tabletop member having a top surface defining a peripheral edge portion and a first contour formed therealong, and a bottom surface adapted for pivotally and spacedly connecting said two leg assemblies thereon, and an engaging rim, which is provided along a peripheral edge portion of said bottom surface of said tabletop member, defining a second contour formed therealong, wherein said second contour of said engaging rim has a size and shape geometrically matching with said first contour of said top surface, wherein said tabletop member has a top resting edge as said first contour formed along said peripheral edge portion of said top surface, wherein said second contour is an engaging edge groove indently and peripherally extended along an inner surface of said engaging rim, wherein said engaging edge groove of said second contour is shaped and sized corresponding to a shape and size of said top resting edge of said first contour of said tabletop member, wherein said tabletop member further has an upper utilizing portion defining within said peripheral edge portion, wherein said engaging rim is downwardly extended from said peripheral edge portion of said bottom surface of said tabletop member to define a receiving cavity within said engaging rim and said bottom surface of said tabletop member for receiving said leg assemblies and for receiving said utilizing portion of said top surface of said another stackable tabletop when said stackable tabletop is piled up of said another stackable tabletop, wherein said engaging rim is downwardly and integrally extended from said peripheral edge portion of said bottom surface of said tabletop member, wherein said tabletop member, which is a double-layer plastic tabletop, comprises a plastic top layer defining said top surface thereon and a plastic bottom layer which defines said bottom surface thereon and is overlappedly connected to said top layer in an edge to edge manner to form an air chamber between said top and bottom layers, whereby said stackable tabletop is adapted to overlappedly stack on another stackable tabletop by engaging said second contour of said engaging rim of said stackable tabletop with said first contour of said top surface of said another stackable tabletop so as to substantially retain said two stackable tabletops in position and avoid a lateral relative movement between said stackable tabletop and said another stackable tabletop, whereby, when said two stackable tabletops are piled up with each other, said top resting edge of said another stackable tabletop is engaged with said engaging edge groove and surrounded by said engaging rim of said stackable tabletop so as to substantially retain said two stackable tabletop and avoid said lateral relative movement between said stackable tabletop and said another stackable tabletop.

10. The stackable tabletop, as recited in claim 9, further comprising two side-runners supported within said air chamber to longitudinally extend two longitudinal side edge portions of said tabletop member respectively.

11. A stackable tabletop for a foldable table having two leg assemblies, wherein said tabletop comprises:

a tabletop member having a top surface defining a peripheral edge portion and a first contour formed therealong, and a bottom surface adapted for pivotally and spacedly connecting said two leg assemblies thereon, and an engaging rim, which is provided along a peripheral edge portion of said bottom surface of said tabletop member, defining a second contour formed therealong, wherein said second contour of said engaging rim has a size and shape geometrically matching with said first contour of said top surface, wherein said tabletop member has a top resting edge as said first contour formed along said peripheral edge portion of said top surface, wherein said second contour is an engaging edge groove indently and peripherally extended along an inner surface of said engaging rim, wherein said engaging edge groove of said second contour is shaped and sized corresponding to a shape and size of said top resting edge of said first contour of said tabletop member, wherein said tabletop member further has an upper utilizing portion defining within said peripheral edge portion, wherein said engaging rim is downwardly extended from said peripheral edge portion of said bottom surface of said tabletop member to define a receiving cavity within said engaging rim and said bottom surface of said tabletop member for receiving said leg assemblies and for receiving said utilizing portion of said top surface of said another stackable tabletop when said stackable tabletop is piled up of said another stackable tabletop, wherein said engaging rim is affixed to said peripheral edge portion of said bottom surface of said tabletop member, wherein said tabletop member, which is a double-layer plastic tabletop, comprises a plastic top layer defining said top surface thereon and a plastic bottom layer which defines said bottom surface thereon and is overlappedly connected to said top layer in an edge to edge manner to form an air chamber between said top and bottom layers, whereby said stackable tabletop is adapted to overlappedly stack on another stackable tabletop by engaging said second contour of said engaging rim of said stackable tabletop with said first contour of said top surface of said another stackable tabletop so as to substantially retain said two stackable tabletops in position and avoid a lateral relative movement between said stackable tabletop and said another stackable tabletop, whereby, when said two stackable tabletops are piled up with each other, said top resting edge of said another stackable tabletop is engaged with said engaging edge groove and surrounded by said engaging rim of said stackable tabletop so as to substantially retain said two stackable tabletop and avoid said lateral relative movement between said stackable tabletop and said another stackable tabletop.

12. The stackable tabletop, as recited in claim 11, further comprising two side-runners supported within said air chamber to longitudinally extend two longitudinal side edge portions of said tabletop member respectively.

* * * * *